United States Patent [19]

Wakeman

[11] 4,353,338

[45] Oct. 12, 1982

[54] ENGINE IDLE AIR VALVE MEANS AND SYSTEM

[75] Inventor: Russell J. Wakeman, Novi, Mich.

[73] Assignee: Colt Industries Operating Corp., New York, N.Y.

[21] Appl. No.: 93,502

[22] Filed: Nov. 13, 1979

[51] Int. Cl.[3] ..... F02D 11/10

[52] U.S. Cl. ..... 123/339; 123/585

[58] Field of Search ..... 123/587, 437, 438, 339, 123/585

[56] References Cited

U.S. PATENT DOCUMENTS

| | | | |
|---|---|---|---|
| 2,070,009 | 2/1937 | Goodman | 123/437 |
| 2,159,173 | 5/1939 | Mennesson | 123/437 |
| 2,223,381 | 12/1940 | Mock | 261/DIG. 51 |
| 2,239,305 | 4/1941 | Tacconi | 123/437 |
| 2,247,189 | 6/1941 | De Guyon | 261/DIG. 51 |
| 3,866,588 | 2/1975 | Nakada | 123/587 |
| 3,931,814 | 1/1976 | Rivere | 261/DIG. 82 |
| 4,159,014 | 6/1979 | Szott | 261/DIG. 51 |
| 4,196,709 | 4/1980 | Toryu | 123/587 |
| 4,201,169 | 5/1980 | Michassouridis | 123/587 |
| 4,237,838 | 12/1980 | Kinugawa | 123/587 |
| 4,242,998 | 1/1981 | Shioya | 123/587 |
| 4,249,505 | 2/1981 | Nishimuka | 123/587 |
| 4,257,227 | 3/1981 | Sato | 123/587 |

*Primary Examiner*—Ronald B. Cox

*Attorney, Agent, or Firm*—Walter Potoroka, Sr.

[57] ABSTRACT

An air valve means is shown as having a pressure responsive diaphragm positioned valve member which is positioned as to supply controlled rates of engine idle air flow to the associated combustion engine; the positioning of such valve member is in response to forces created as by pressure differential, across the diaphragm, the magnitude of which is controllable by associated control apparatus responsive as to indicia of engine operation.

9 Claims, 4 Drawing Figures

ENGINE IDLE AIR VALVE MEANS AND SYSTEM

FIELD OF THE INVENTION

This invention relates generally to combustion engines and more particularly to means for supplying increased quantities of air flow to such engines during cold engine idle operation as to prevent, for example, engine stalling and/or rough engine operation.

BACKGROUND OF THE INVENTION

Currently, there are many proposals of various forms and embodiments of fuel metering and supply systems for use in combination with combustion engines. Many of such fuel metering and supply systems are being proposed as being improvements capable of providing more accurate metering in terms of the associated engine's actual needs.

In many of such fuel systems, such as, for example, fuel injection or electronic cold enrichment carburetors, there is no bimetal and/or throttle fast idle cam to provide the high idle air flow required for a cold engine to run initially. Further, prior art throttle fast idle cam means, or the like, are incapable of providing for closed loop control of the engine idle speed as may be required because of considerations of fuel economy, engine exhaust emissions or providing for tamperproof of engine idle speed.

Accordingly, the invention as herein disclosed and claimed is primarily directed to the solution of the aforementioned as well as other related and attendant problems of idle engine air flow.

SUMMARY OF THE INVENTION

According to the invention, an engine idle air flow system comprises pressure responsive valve means openable and closeable in response to the application thereto of vacuum of varying magnitude, said valve means when being opened being effective to supply increased rates of flow of ambient air to said engine, and control means responsive to indicia of engine operation for controlling the magnitude of said vacuum applied to said valve means.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
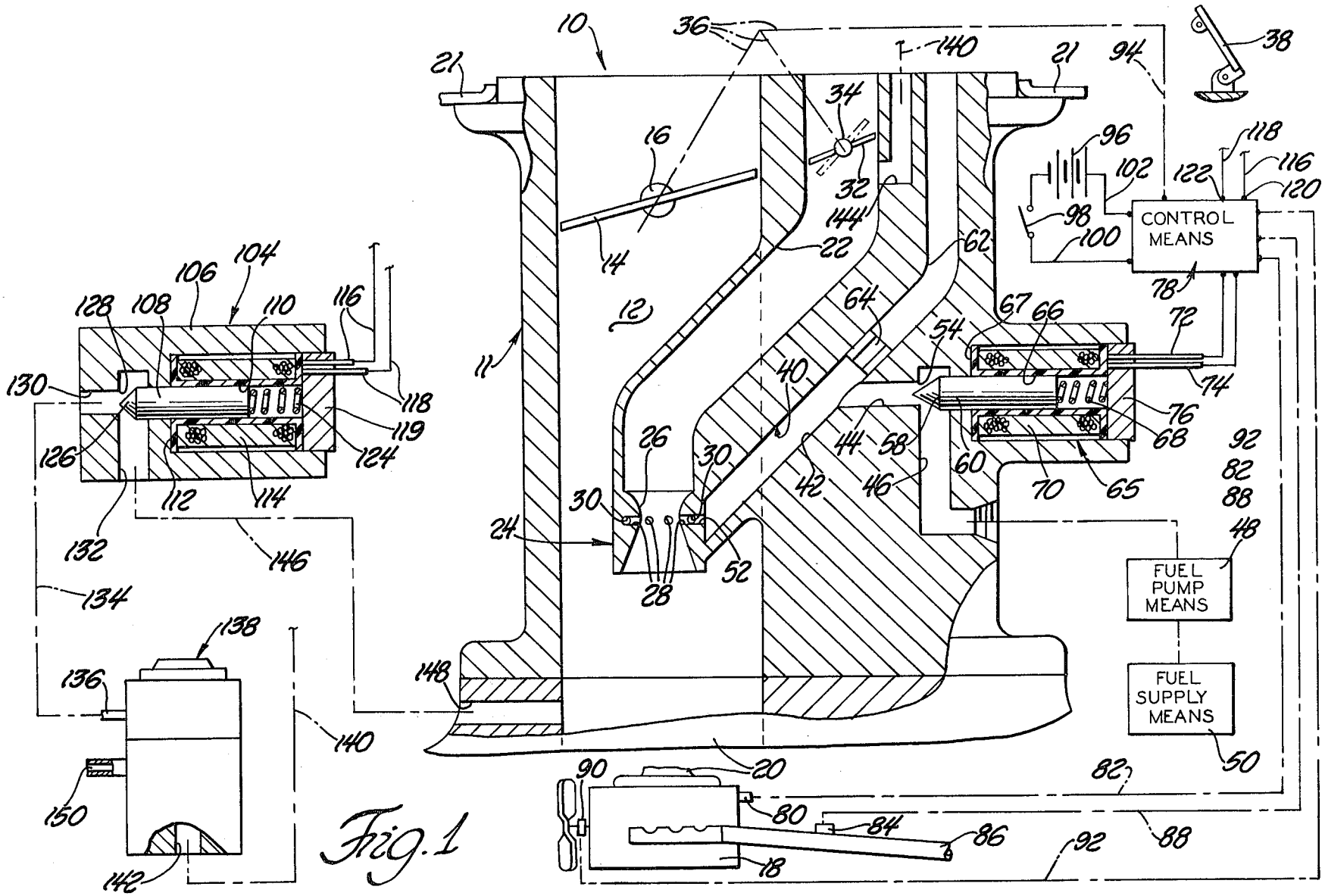
FIG. 1 illustrates a fuel metering system along with an engine idle air valve assembly, shown in possibly reduced scale, employing teachings of the invention.

Referring now in greater detail to the drawings, FIG. 1 illustrates fuel injection apparatus and system 10 comprised as of induction body or housing means 11 having main induction passage means 12 wherein a throttle valve 14 is situated and carried as by a rotatable throttle shaft 16 for rotation therewith thereby variably restricting the flow of air through the induction passage means 12 and into the engine 18 as via associated engine intake manifold means 20. If desired, suitable air cleaner means may be provided as to generally encompass the inlet of induction passage means 12 as generally fragmentarily depicted at 21. Second or separate induction passage means 22 is also provided in housing means 10 as for the passage therethrough of idle engine operation air flow. As depicted, the downstream portion of induction passage means 22 communicates as with fuel discharge nozzle means 24 which preferably comprises a venturi-like fuel atomizing portion 26 provided with fuel discharge port means comprised as of a plurality of discharge ports 28 communicating with an annulus 30. An idle air flow throttling valve 32, situated in auxiliary induction passage 22, may be carried by related rotatable shaft means 34 for pivotal rotation therewith. The throttling valve means 14 and 32 may be suitably operatively interconnected as through related linkage and motion transmitting means 36 to the operator positioned throttle control means which may be the operator foot-operated throttle pedal or lever 38 as usually provided in automotive vehicles.

Fuel supply conduit or passage means 40 may comprise, for example, a first passage portion 42 communicating with a second passage portion 44 which may, in turn, communicate with a third passage portion 46 leading as to related fuel pumping means 48 which receives its fuel as from associated fuel supply or reservoir means 50. Conduit or passage portion 42 is placed in communication with the discharge orifice means 28 as by suitable conduit means 52 effectively communicating between passage 42 and annulus 30. A valve seat or orifice 54 formed as at the effective intersection of conduit portions 44 and 46 is effective for cooperating with the valve surface 58 of a valving member 60. Further, passage means 40, as at a point downstream of valve orifice 54, is preferably in communication with a source of ambient atmosphere as by conduit means 62 comprising calibrated restriction passage means 64.

Valve member 60 is illustrated as comprising a portion of an overall oscillator type valving means or assembly 65 which is depicted as comprising a spool-like bobbin 67 having inner passage means 66 slidably receiving therein valve member 60 and spring means 68 yieldingly urging valve member 60 generally toward the left and into seated engagement with valve orifice or seat means 54. A field or solenoid winding or coil 70 is carried by the bobbin 64 and has its opposite electrical ends connected as to electrical conductors 72 and 74 which may pass through suitable closure means 76 and be electrically connected as to related control means 78. The practice of the invention is not limited to, for example, a particular fuel metering means; however, in the preferred embodiment, the metering valving means 65 is of the duty-cycle type wherein the winding 70 is intermittently energized thereby causing, during such energization, valve member 60 (which may be the armature) to move in a direction away from valve orifice or seat means 54. As should be apparent, with such a duty-cycle type metering solenoid assembly the effective flow area of the valve orifice 54 can be variably and controllably determined by controlling the frequency and/or duration of the energization of coil means 70.

The control means 78 may comprise, for example, suitable electronic logic type control and power output means effective to receive one or more parameter type input signals and in response thereto produce related outputs. For example, engine temperature responsive transducer means 80 may provide a signal via transmission means 82 to control means 78 indicative of the engine temperature; sensor means 84 may sense the relative oxygen content of the engine exhaust gases (as within engine exhaust conduit means 86) and provide a signal indicative thereof via transmission means 88 to control means 78; engine speed responsive transducer means 90 may provide a signal indicative of engine speed via transmission means 92 to control means 78 while engine load, as indicated for example by throttle valve 14 position, may provide a signal as via transmission means 94 to control means 78. A source of electrical potential 96 along with related switch means 98 may be electrically connected as by conductor means 100 and 102 to control means 78.

A second valving means is illustrated, at 104, as comprising housing means 106 containing a valving member 108 slidably received as within a tubular portion 110 of bobbin means 112 which carries a field winding or coil 114 having electrical leads or conductor means 116 and 118 which may extend through suitable cover means 119 and which may be electrically connected as at 120 and 122 to the control means 78. A spring 124 normally urges valve member 108 in a direction whereby valve surface 126 is moved toward seated engagement with orifice or valve seat means 128 leading to a conduit means 130 formed in housing 106. A second conduit means 132, formed in housing 106 is, by virtue of valve member 108, placed in controlled communication with conduit means 130. Suitable conduit means 134 serves to operatively interconnect conduit 130 with a conduit 136 of idle air valve assembly 138 while second suitable conduit means 140 serves to operatively interconnect a conduit or passage means 142 of valve assembly 138 with passage or conduit means 144 communicating as with induction passage means 22 downstream of throttle valve means 14 and 32. Additional conduit means 146 serves to interconnect conduit means 132 with conduit or passage means 148 communicating with the induction passage means as at a point in the intake manifold means 20. A third conduit means or passage means 150 serves as an inlet means conveying air, as from a suitable source of ambient atmospheric air, to the valve assembly 138.

Figure 2:
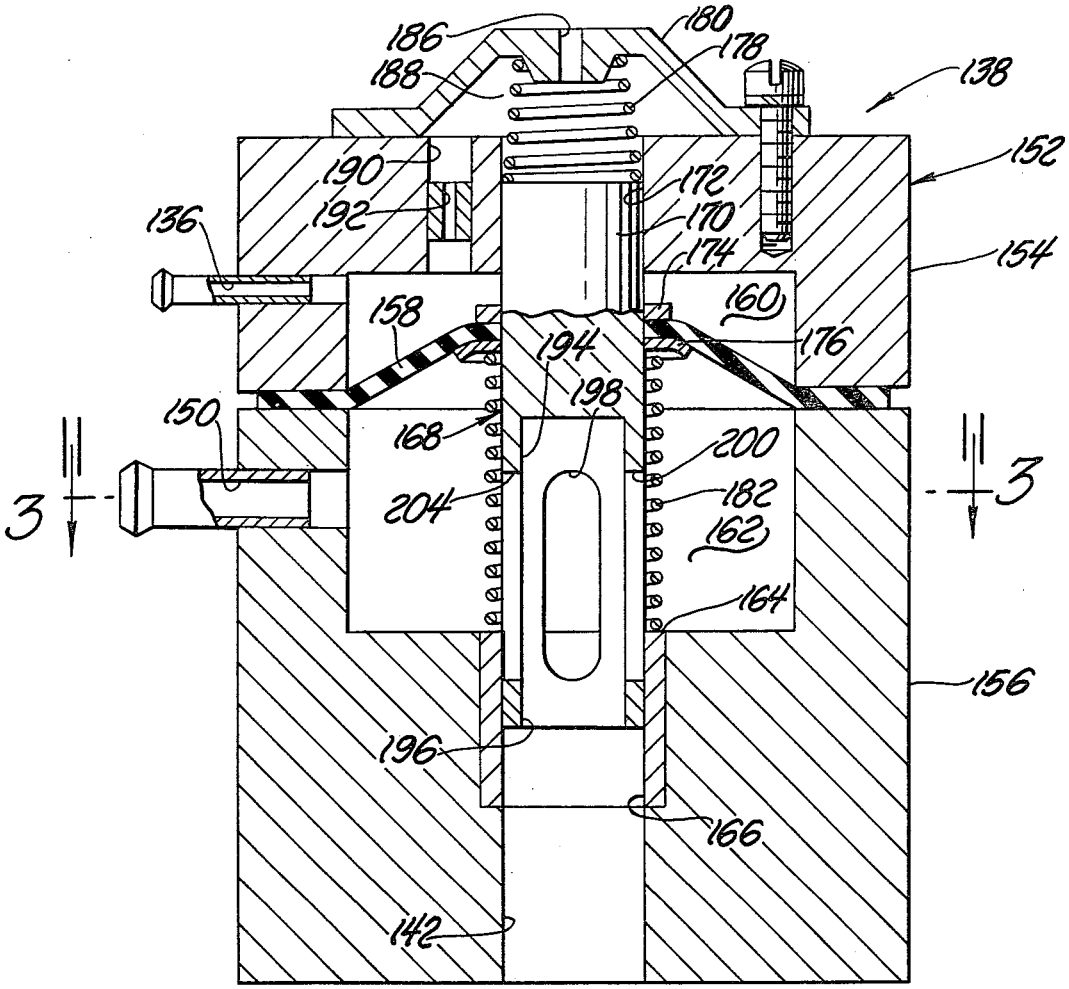
FIG. 2 is an enlarged view, in generally axial cross-section, of the air valve assembly of FIG. 1.
Figure 3:
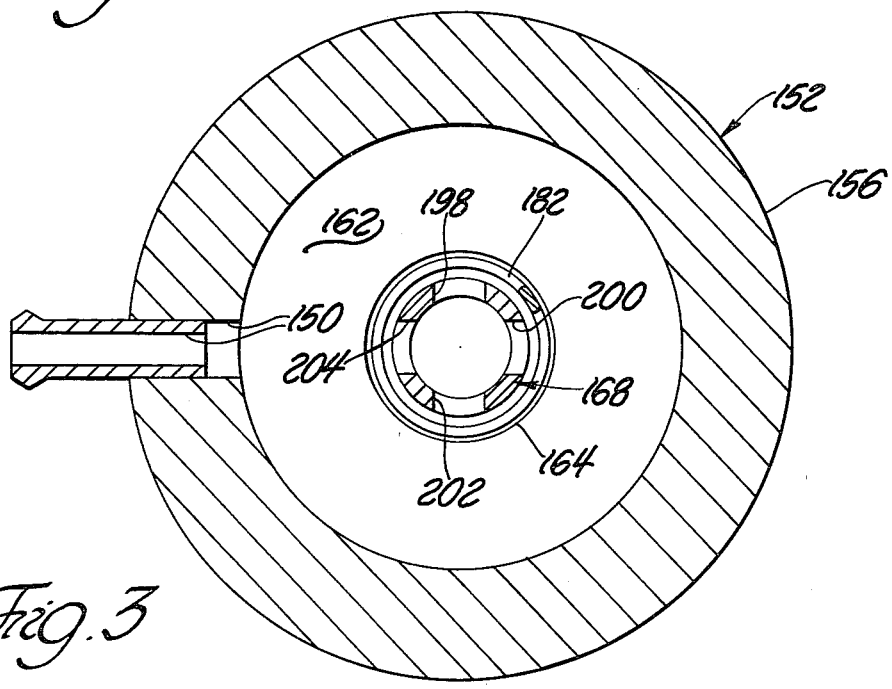
FIG. 3 is a cross-sectional view taken generally on the plane of line 3—3 of FIG. 2 and looking in the direction of the arrows.

Referring in greater detail to FIGS. 2 and 3, the idle air valve assembly 138 is illustrated as comprising housing or body means 152 which, in turn, is comprised as of housing or body sections 154 and 156 fixedly secured to each other, as by any suitable fastening means not shown, as in a manner whereby a pressure responsive wall means or diaphragm 158 is peripherally secured therebetween to define, in effect, movable wall means effectively defining at opposite sides thereof variable but distinct chambers 160 and 162. Housing section 156 may be provided with a guide-like tubular bushing or bearing member 164 the inner passage 166 of which is preferably cylindrical and which may be of a cross-sectional dimension approximating or equal to passage 142.

A generally elongated valving member 168 has its lower end (as viewed in FIG. 2) preferably closely guidingly received within bearing or bushing passage 166 for sliding motion relative thereto. The upper or opposite end 170 of valve member is slidingly received within a cooperating passage or bearing surface means 172 carried by housing section 154.

In the embodiment disclosed, the valve member 168 extends through diaphragm 158 which, in turn, is suitably sealingly and fixedly secured to the valve member 168 as by oppositely disposed and cooperating backing plates 174 and 176.

A first preload type spring means 178, situated as against a spring stop or abutment 180, urges the valve member 168 downwardly (as viewed in FIG. 2) while a second spring means 182, situated as generally within chamber means 162 and operatively engaging valve member 168 as through diaphragm backing or retainer plate 176, urges the valving member 168 upwardly (also as viewed in FIG. 2). The spring abutment 180 may, in fact, be a cover-like housing member which is secured, as by screws, of which one is illustrated at 184, to housing section 154. Preferably, suitable passage means as at 186 is provided in order to communicate ambient atmosphere into the interior chamber-like space 188. It should, of course, be apparent that adjustment means, such as a screw or the like, could be provided in cooperation with abutment member 180 whereby the spring 178 would be seated against such adjustment means in order to thereby be able to selectively adjust or determine the preload force of spring means 178. Calibrated passage means 190, which may comprise calibrated restriction means 192, communicates as between chamber 160 and a source of ambient atmosphere as at 188. Also, as shown, conduit or passage means 136 communicates with chamber 160.

Valving member 168 is formed to provide an axially extending internally situated conduit or passage means 194 having an open end 196 communicating with passages 166 and 142. Also, a plurality of generally elongated passage means or apertures 198, 200, 202 and 204 are formed through what might be considered the wall portion of valve member 168 in order to, for example, complete communication as between chamber 162 and inner passage 194 of valve member 168. As shown, conduit means 150 communicates with chamber 162. Generally, it should be apparent that as valve member 168 is moved further downwardly, bushing means 164 serves to close off an ever increasing area of each of said apertures 198, 200, 202 and 204 thereby progressively diminishing the degree of communication as between chamber 162 and the inner conduit means 194 and passage means 166 and 142.

OPERATION OF INVENTION

Referring first primarily to FIG. 1, fuel under regulated, substantially constant, pressure is supplied as by fuel pump means 48 to conduit 46 and such fuel is metered through the effective metering area of valve or metering orifice means 54 to conduit portion 44 from where such metered fuel flows into conduit portion 42, through passage 52 into annulus 30 and ultimately through discharge port means 28 and to the engine 18. The rate of metered fuel flow, in the arrangement of FIG. 1, will be dependent upon the relative percentage of time, during an arbitrary cycle of time or elapsed time, that the valve surface 58 is relatively close to or seated against valve orifice seat 54 as compared to the percentage of time that the valve surface 58 is relatively far away from the cooperating valve orifice seat 54. This, in turn, is dependent on the output to coil 70 from control means 78 which, in turn, is dependent on the various parameter signals received by the control means 78. For example, if the oxygen sensor and transducer means 84 senses the need of a further fuel enrichment in the motive fluid being supplied to the engine and transmits a signal reflective thereof to the control means 78, the control means 78, in turn, will require that the metering valve 60 be opened a greater percentage of time as to provide the necessary increased rate of metered fuel flow. The practice of the invention is not limited to a particular form of fuel metering means or to a particular system for the control of such fuel metering means. Accordingly, it will be understood that given any selected parameters and/or indicia of engine operation and/or ambient conditions, the control means 78 will respond to the signals generated thereby and respond as by providing appropriate energization and de-energization of coil means 70 (causing corresponding movement of valve member 60) thereby achieving the then required metered rate of fuel flow to the engine.

In FIG. 1, two separate induction passages, one being the main induction passage 12 and the other being the auxiliary or idle induction passage 22 effectively join with each other as at a point downstream of the main throttle valve means 14 and preferably upstream of where such induction passage 12 discharges into the engine 18. Main throttle valve means 14 and auxiliary or idle throttle valve means 32 control the rate of air flow through such main and auxiliary induction passage means, respectively.

That is, without yet considering the operation of valve assembly 138, during curb idle and a portion of the idle engine operation, the main air throttle means 14 may be generally fully closed while the auxiliary or idle air throttle valve means 32 is partly opened thereby requiring that generally all air flow to the engine 18 pass through induction passage means 22. Such idle air flow passing through the venturi portion 26 of discharge nozzle means 24 produces a reduced pressure in the area of the fuel discharge port means 28 thereby assisting in the flow of such metered fuel into the stream of idle air flowing through the nozzle 24. As such fuel-air mixture passes from the nozzle 24 and into the main induction passage means 12, it undergoes a further and substantial expansion which, in turn, results in a further atomization of the fuel within the fuel-air mixture prior to its introduction into the engine 18.

As increased idle engine loads are experienced, the idle or auxiliary air throttle valve means 32 is further opened, as by means 36 and 38, and eventually, with still further increasing engine loads opening of the main air throttle means 14 is initiated. Such, in effect, staged opening of the auxiliary and main air throttle valves 32 and 14 may be accomplished by any suitable means including, for example, lost-motion connecting means (many forms of which are well known in the art) which may comprise a portion of the linkage or control means 36.

The fuel downstream of the metering means 54, 58, that is, metered fuel, is permitted to become commingled with, for example, ambient air as provided through calibrated passage means 64. Such commingling of metered fuel and air results in a fuel-air atomization which, in turn, has, for unit of volume, a substantially less density and thereby becomes more responsive to variations in pressure changes as within the throat of the venturi section 26 of the fuel discharge nozzle 24.

Generally, the operation of valving means 104 may be as that of valving or metering means 65. That is, the rate of flow or the degree of restrictive quality exhibited by valving means 104 will be dependent upon the relative percentage of time, during an arbitrary cycle time or elapsed time, that the valve surface 126 is relatively close to or seated against valve orifice seat 128 as compared to the percentage of time that the valve surface 126 is relatively far away from the cooperating valve orifice seat 128. This, in turn, is dependent on the output to coil means 114 from control means 78 which, in turn, is dependent on the various parameter signals received by the control means 78. For example, if the engine is cold and transducer 80 sends a signal reflective thereof to control means 78, the control means 78, in turn, will require valving member 108 to be opened a greater percentage of time as to provide the desired pressure differential across pressure responsive movable wall or diaphragm means 158 to thereby move valve member 168 upwardly (as viewed in FIG. 2) in order to more fully open apertures 198, 200, 202 and 204 and thereby admit increased rates of idle air flow to the engine 18.

More particularly, also referring to FIGS. 2 and 3, it can be seen that chamber 160 is, via conduit means 136, 134, 130, 132, 146 and 148, in communication with a source of engine or intake vacuum with valving means 104 functioning, in effect, as a variable restrictor thereby permitting (depending upon the degree of restriction exhibited) less or greater magnitudes of such vacuum to be communicated to chamber 160. Calibrated passage means 190 continually bleeds atmospheric air into chamber 160 and therefore, it can be seen that the system described by chamber 160, calibrated passage means 190, conduit means 136, 134, 130, 132, 146 and 148 and valve means 104 is one of having a variable restriction means (104) in series with a fixed restriction means (190, 192) and chamber 160 whereby the more nearly valve means 104 serves less a restrictor the more nearly the magnitude of the vacuum in chamber 160 approaches the magnitude of the source of such vacuum. This then enables the control of the magnitude of the vacuum in chamber 160 to selected magnitudes to achieve desired movement of valving member 168 in response to certain indicia of engine operation.

For example, during cold engine idle operation, it is known that additional rates of flow of idle air (additional in comparison to what would otherwise be required during, for example, idle engine operation during normal engine operating temperatures) must be supplied to the engine in order to prevent engine stalling and rough engine operation.

It is generally well known that during idle engine operation the magnitude of the intake vacuum is of a high magnitude being exceeded, for example, during closed throttle engine deceleration where the vehicle is, in effect, decelerating and in the process driving the engine. Accordingly, let it be assumed that the engine 18 is cold, has been started and is operating at cold idle with the intake or manifold vacuum being relatively high. At this time, for example, transducer 80 senses the cold engine temperature and supplies a signal reflective thereof to control means 78. This "cold engine" signal may, in turn, cause the control means to require a new set speed for the cold engine idle speed which could be, for example, some preselected increase over the engine set speed during normal engine temperature idle operation. Engine speed sensor transducer means 90 would provide a signal, indicative of engine speed, to control means 78. As a consequence thereof, control means 78 would cyclically energize valve means 104 as to result in a situation wherein the percentage of time that valve surface 126 was away from seat 128 was relatively increased thereby enabling the magnitude of the vacuum communicated to chamber 160 of valve assembly 138 to be more nearly the magnitude of the source of such vacuum. At the same time, the manifold or intake vacuum is communicated via conduit means 140 and 142 thereby existing within passage 194 as well as being applied generally to the face or lower end of valve member 168. In comparison, the upper (as viewed in FIG. 2) end surface 206 is exposed to ambient atmosphere thereby resulting in a pressure differential (of atmosphere to intake vacuum) generally axially of valve member 168 causing a corresponding force tending to move the valve member 168 downwardly (as viewed in FIG. 2). The force of such axially directed pressure differential may be sufficient to overcome and balance any oppositely directed force from spring 182.

Consequently, the pressure differential created across movable wall or diaphragm means 158, by virtue of the admission of manifold or engine vacuum to chamber 160, creates an upwardly directed force thereagainst which moves diaphragm 158 and valve member 168 to its maximum upper position thereby, for example, fully opening apertures 198, 200, 202 and 204 to chamber 162 which is in communication with a source of ambient atmosphere as via conduit means 150. (If such an assumed maximum upper position does in fact result in apertures 198, 200, 202 and 204 being fully opened, then the elements as depicted in FIG. 2 would be at a position less than in such an assumed maximum upper position.)

In any event, with the aperture or passage means 198, 200, 202 and 204 being thusly further opened, a greater rate of air flow is permitted to pass therethrough and, via passage means 194, 166, 142, 140 and 144 to the engine induction passage means 22 and 12.

With the arrangement as generally depicted in FIG. 1, engine speed sensing transducer means 90 may provide a signal to control means 78 and such speed signal can then be employed to, in effect, modulate the cold engine (temperature) signal of transducer 80 in order to assure that the cold engine fast idle speed is not less than a preselected or preset cold minimum speed and not more than a preselected or preset cold maximum speed. For example, should cold engine idle speed start to decrease below the cold minimum speed, the signal from transducer 90 would cause control means 78 to energize coil means 114 as to even further increase the percentage of open time of valve member 108 and valve surface 126 thereby increasing the magnitude of the engine vacuum in chamber 160 and further increasing the rate of idle air flow to the engine through conduit means 140. If the cold engine idle speed should start to increase above the cold maximum speed, the signal from transducer would cause control means 78 to energize coil means 114 as to reduce the percentage of open time of valve member 108 and valve surface 126 thereby decreasing the magnitude of the engine vacuum in chamber 160 and further decreasing the rate of idle air flow to the engine through conduit means 140.

Obviously, as engine temperature rises transducer 80 presents an appropriate signal to control means 78 which, in turn, reduces the percentage of open time of valve member 108 and valve surface 126 to accordingly reduce the magnitude of the engine vacuum in chamber 160 and enable spring 178 to move valve member 168 downwardly and further close or reduce the effective opening of aperture means 198, 200, 202 and 204 thereby reducing the rate of flow of idle air through conduit means 142 to engine 18 and, consequently, reducing the speed of the engine. This could progressively continue until normal engine temperature is attained at which time the valve member 168 will have been moved to a position whereat aperture means 198, 200, 202 and 204 are totally closed, or depending on the overall use of the means 138, closed to a preselected minimum opening. If closed to such a preselected minimum opening the valving means 138 may, of course, continually function to provide the necessary (or a portion thereof) idle air flow to the engine. Generally, in those situations as, for example, cold engine operation the control means 78 not only causes an increase in idle air flow via valving means 138 but also increases the rate of metered fuel flow in accordance with a cold engine closed loop metering function. The increasing rate of idle air flow passing through the induction passage means 22 and therefore the nozzle means 24 continues to interact with such increased fuel flow in the same manner as hereinbefore described.

As should be apparent, the valving means 138 and 104 may operate in a closed loop mode as well as an open loop mode depending on the desired inputs to, for example, control means 78. It should also be apparent that any parameter of engine operation, considered to be a factor in determining proper or desired engine operation, may be sensed and signals thereof applied as to control means 78 which, in turn, as through the logic comprising such control means 78, will produce an appropriate energization signal to coil means 114 of valve assembly 104 in order to attain the desired results in the action of idle air valving means 138. The corrections thusly made are in turn sensed by the same transducer means which will produce feedback signals indicative of the presence or absence of an error in the previously instituted correction.

Upon engine shut down the engine or intake manifold vacuum, of course, ceases to exist and any degree of vacuum which may have existed in chamber 160 is, shortly after engine shut down, dissipated via passage means 190. Similarly, any magnitude of vacuum which may have existed in chamber 162 (such occurring due to any restriction to flow of air as may have occurred through conduit means 150) is also dissipated as via conduit means and/or conduit means 142. As a consequence of such engine shut down and the attendant return of ambient pressure to chambers 160 and 162 as well as the attendant cessation of the pressure differential axially across the ends of valving member 168, spring 182 becomes effective for moving valving member 168 upwardly as to fully or more nearly fully open aperture passages 198, 200, 202 and 204 thereby positioning such for the next time at which the engine is to be started.

In FIG. 1, conduit means 146 has been depicted as communicating directly with the interior of an intake manifold 20. However, conduit 146 could communicate directly with passage means 12 within body 11.

SECOND EMBODIMENT

Figure 4:
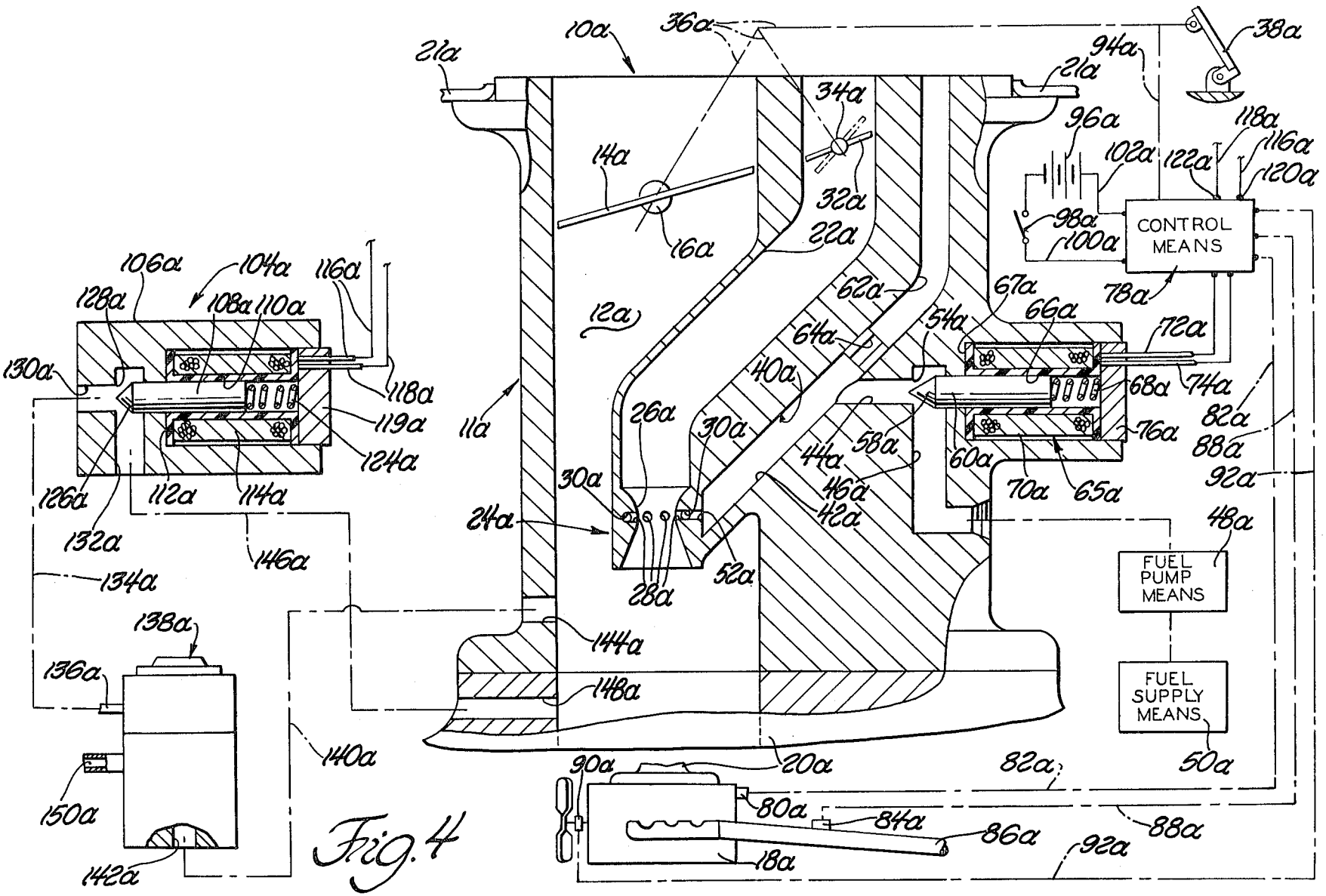
FIG. 4 is a view similar to that of FIG. 1 illustrating another embodiment of a fuel system employing teachings of the invention.

FIG. 4, a view similar to that of FIG. 1 illustrates a second embodiment of a fuel metering system and apparatus employing teachings of the invention.

In FIG. 4, all elements which are like or functionally similar to those of FIG. 1 are identified with like reference numerals provided with a suffix "a". It should be mentioned that if views of valving means 138*a* were taken in a manner corresponding to the way FIGS. 2 and 3 were obtained that such views would, in fact be identical to FIGS. 2 and 3 and the elements, and functions thereof, in such views would be as those of FIGS. 2 and 3.

In comparing the embodiments of FIGS. 1 and 4 it will be seen that the only difference is that instead of discharging the additional idle air into induction passage means 22, as via conduit means 140 and 144 of FIG. 1, in the embodiment of FIG. 4 the additional idle air is discharged into induction passage means 12*a* as via conduit means 140*a* and 144*a* as to thereby not flow through the discharge nozzle 24*a*.

In FIG. 4, conduit means 146*a* has been depicted as communicating directly with the interior of intake manifold 20*a* while conduit means 140*a* has been depicted as communicating directly with the induction passage means portion within the body 11*a*. It should be apparent that: (a) conduits 146*a* and 140*a* could be reversed; (b) both conduits 140*a* and 146*a* could communicate directly with the induction passage means portion within body 11*a* or (c) both conduits 140*a* and 146*a* could communicate directly with the interior of an intake manifold.

What is claimed is:

1. In combination with a combustion engine having induction passage means for the induction into said engine of motive fluid, fuel metering means for supplying metered rates of fuel flow to said induction passage means, throttle valve means for variably restricting the rate of flow of air through said induction passage means, and additional air valve means, said additional air valve means being effective to bypass said throttle valve means and supply a bypass-flow of air to said induction passage means downstream of said throttle valve means, said additional air valve means being pressure responsive, wherein engine vacuum within said induction passage means is transmitted to said additional air valve means for actuation thereof, said additional air valve means comprising first and second distinct but variable chambers, pressure responsive movable wall means situated generally between and separating said first and second chambers, movable valve means carried by said movable wall means for movement therewith, aperture means openable and closeable by movement of said movable valve means, first passage means operatively interconnecting said first chamber with said induction passage means as to thereby convey said engine vacuum from said induction passage means to said first chamber, second passage means operatively interconnecting said second chamber with a source of ambient air, and third passage means operatively interconnecting said aperture means with said induction passage means as to thereby convey as said bypass-flow such air as is obtained from said source of ambient air to said induction passage means, said movable valve means comprising first and second axially oppositely disposed ends, wherein the projected surface area of said first end is exposed to a source of ambient atmospheric pressure, and wherein the projected surface area of said second end is exposed to the pressure of said engine vacuum.

2. In combination with a combustion engine having induction passage means for the induction into said engine of motive fluid, fuel metering means for supplying metered rates of fuel flow to said induction passage means, throttle valve means for variably restricting the rate of flow of air through said induction passage means, and additional air valve means, said additional air valve means being effective to bypass said throttle valve means and supply a bypass-flow of air to said induction passage means downstream of said throttle valve means, said additional air valve means being pressure responsive, wherein engine vacuum within said induction passage means is transmitted to said additional air valve means for actuation thereof, wherein said additional air valve means comprises first and second distinct but variable chambers, pressure responsive movable wall means situated generally between and separating said first and second chambers, movable valve means carried by said movable wall means for movement therewith, aperture means openable and closeable by movement of said movable valve means, first passage means operatively interconnecting said first chamber with said induction passage means as to thereby convey said engine vacuum from said induction passage means to said first chamber, second passage means operatively interconnecting said second chamber with a source of ambient air, third passage means operatively interconnecting said first chamber with a source of ambient atmosphere, and fourth passage means operatively interconnecting said aperture means with said induction passage means as to thereby convey as said bypass-flow such air as is obtained from said source of ambient air to said induction passage means.

3. The combination according to claim 1 wherein said first end and said first chamber are each situated generally on one side of said pressure responsive movable wall means, and wherein said second end and said second chamber are each situated generally on an other side of said pressure responsive movable wall means opposite to said one side.

4. The combination according to claim 2 and further comprising resilient means for resiliently urging said movable valve means in a direction whereby said aperture means becomes more nearly fully closed.

5. The combination according to claim 2 and further comprising resilient means for resiliently urging said movable valve means in a direction whereby said aperture means becomes more nearly fully opened.

6. The combination according to claim 2 and further comprising first resilient means for resiliently urging said movable valve means in a first direction whereby said aperture means becomes more nearly fully closed, and second resilient means for resiliently urging said movable valve means in a second direction opposite to said first direction whereby said aperture means becomes more nearly fully opened.

7. The combination according to claim 6 wherein said pressure responsive movable wall means comprises a pressure responsive movable diaphragm.

8. The combination according to claim 2 wherein said movable valve means comprises first and second axially oppositely disposed ends, wherein the projected surface area of said first end is exposed to a source of ambient atmospheric pressure, and wherein the projected surface area of said second end is exposed to the pressure of said engine vacuum.

9. The combination according to claim 8 wherein said first end and said first chamber are each situated generally on one side of said pressure responsive movable wall means, and wherein said second end and said second chamber are each situated generally on an other side of said pressure responsive movable wall means opposite to said one side.

* * * * *